United States Patent [19]

Sampson et al.

[11] Patent Number: 4,896,468

[45] **Date of Patent: * Jan. 30, 1990**

[54] SKYLIGHT SEALING

[75] Inventors: Robert Sampson, Sanford; Sean Flanigan, Wells, both of Me.

[73] Assignee: Wasco Products, Inc., Sanford, Me.

[ * ] Notice: The portion of the term of this patent subsequent to May 20, 2003 has been disclaimed.

[21] Appl. No.: 94,870

[22] Filed: Sep. 10, 1987

Related U.S. Application Data

[63] Continuation of Ser. No. 857,940, Apr. 30, 1986, Pat. No. 4,702,049, which is a continuation-in-part of Ser. No. 839,419, Mar. 14, 1986, Pat. No. 4,703,592, which is a continuation-in-part of Ser. No. 749,947, Jun. 17, 1985, Pat. No. 4,589,238.

[51] Int. Cl.[4] ..... E04B 7/18

[52] U.S. Cl. ..... 52/200

[58] Field of Search ..... 52/58–60, 52/200, 72

[56] References Cited

U.S. PATENT DOCUMENTS

| | | | |
|---|---|---|---|
| 4,527,368 | 7/1985 | Jentoft | 52/200 |
| 4,589,238 | 5/1986 | Sampson et al. | 52/200 |
| 4,702,049 | 10/1987 | Sampson et al. | 52/200 |
| 4,703,592 | 11/1987 | Sampson et al. | 52/200 |

*Primary Examiner*—James L. Ridgill, Jr.

*Attorney, Agent, or Firm*—Wolf, Greenfield & Sacks

[57] ABSTRACT

A technique for sealing a skylight at its curb frame about an opening in a building and in which the sealing technique is a dry sealing technique. In accordance with the invention, means are provided for directly securing the curb frame to the building. A flexible flashing flange extends from the base of the curb frame and is disposed about the periphery of the curb frame having a plurality of elongated spaced upstanding ribs that form flow diverters extending peripherally about the curb frame. The plurality of elongated spaced upstanding ribs are preferably provided in spaced sets each of a plurality of ribs.

56 Claims, 6 Drawing Sheets

210
212
214
216
218
220
222
224
225
230
231
232
233
235
240
244
250
252
254
256
257
260
A
B
C
D

SKYLIGHT SEALING

This application is a continuation of application Ser. No. 857,940, filed Apr. 30, 1986, now No. 4,702,049 which in turn is CIP of Ser. No. 839,419 filed Mar. 14, 1986 now 4,703,590 which in turn is a CIP of ser. No. 749,947 filed June 27, 1985 now Pat. No. 4,589,238.

BACKGROUND OF THE INVENTION

The present invention relates in general to skylights and the like, and is concerned, more particularly, with an improved technique for sealing the skylight about a roof or other building opening.

At the present time, a skylight is conventionally secured to a roof or other appropriate part of the building with the use of a roofing mastic. In an existing building, after the roof opening has been made, the roofing mastic is applied on the deck around the opening to provide a seal between the deck and the flange of the skylight. Once the roofing mastic is applied, then the skylight is positioned over the opening and the flange is then pressed firmly into the mastic to provide a water tight seal. The skylight flange is then nailed to the roof and additional mastic applied. Shingling is then completed about the entire skylight.

Now, there are a number of disadvantages associated with this conventional well-known procedure for sealing a skylight. There is extra expense associated in purchasing the roofing mastic and there is associated expense of the labor involved in applying the mastic. The application of a roofing cement also adds to the installation time of the skylight unit. The roofing mastic product is extremely messy, particularly for an inexperienced remodeler or one involved in a do-it-yourself project. Furthermore, the success of the installation, particularly as it relates to resisting water leakage is a function of steps that are taken that take place in the field and have nothing to do with the manufacturing of the unit. Because of this, there are many uncertainties that are involved. Also, the resistance of the unit to leakage involves the proper performance of the mastic. Because there are a large number of different mastics that are available, this introduces great variables into the desired performance.

Reference is also made to copending application Ser. No. 06/453,339, now U.S. Pat. No. 4,527,368, dated July 9, 1985, commonly owned by the assignee herein and which describes a sealing technique for skylights. Although this technique is effective in the preferred embodiment, it uses one or more nails for piercing the flange. This may have the effect of causing further leakage problems at the flange.

Reference is also made herein to copending application Ser. No. 06/749,947, filed June 27, 1985, in which there is described a curb frame having a co-extruded peripheral flexible flashing flange extending thereabout with the bottom surface of the flange being substantially flat and having a plurality of elongated spaced upstanding ribs that form flow diverters extending peripherally about the curb frame. While this arrangement functions quite satisfactorily, it has been found that improved flow diversion is possible by providing the upstanding ribs in spaced sets.

Accordingly, it is an object of the present invention to provide an improved technique for the sealing of a skylight about a building opening, and in which the sealing flange is secured preferably without requiring the piercing by nails or other fasteners therethrough.

Another object of the present invention is to provide a sealing technique as in accordance with the previous object, particularly adapted for sealing skylights and which is a dry seal technique.

A further object of the present invention is to provide an improved sealing technique as set forth hereinbefore and in which the sealing is provided by a dry seal, co-extruded element.

Still another object of the present invention is to provide a technique for sealing a skylight to a building about an opening in the building and without requiring the use of messy, expensive and time consuming roofing cements or mastics.

Still a further object of the present invention is to provide an improved skylight sealing technique that eliminates uncertainties when the unit is installed in the field due to inherent invariables associated with field installation.

Still another object of the present invention is to provide an improved skylight sealing technique that is particularly useful in skylight installations wherein skylights are butted closely together. Adjacent skylight flanges are adapted to overlap without the required use of caulking or mastic therebetween.

A further object of the present invention is to provide an improved skylight sealing technique in which the fastening of the skylight curb is carried out by separate means whereby the structural securing of the skylight curb frame does not rely upon a securing of the flange itself directly to the building.

Still a further object of the present invention is to provide an improved skylight sealing technique employing a co-extruded flexible flashing flange having a series of upwardly directed flow diverter ribs for assuring proper sealing and water deflection.

Another object of the present invention is to provide an improved skylight sealing technique in which the fastening of the skylight curb frame may be carried out by alternate means permitting securing either on the inside or outside of the curb frame.

Still another object of the present invention is to provide an improved skylight sealing technique employing a simplified means for securing the curb frame without requiring the use of a separate securing clip.

A further object of the present invention is to provide an improved skylight sealing technique that is particularly useful in skylight installations wherein skylights are butted closely together and in which instance, there is provided a common fastener for adjacent skylight curb frames. The common fastener is preferably in the form of an elongated securing clip that extends between adjacent curb frames.

SUMMARY OF THE INVENTION

To accomplish the foregoing and other objects, features and advantages of the invention, there is provided a skylight for covering an opening in a building having a curb frame with a co-extruded peripheral flexible flashing flange extending thereabout. This flashing flange is made of a flexible plastic material and is co-extruded with the curb frame. The bottom surface of the flashing flange is preferably substantially flat while the upper surface thereof has closely spaced upstanding ribs that form flow diverters so as to divert water away from the building. In accordance with the installation of the skylight, the skylight curb frame itself is secured by separate clip means so that the securing of the curb frame does not have to rely upon a securing through the flashing flange itself. As a matter of fact, in a preferred embodiment of the present invention, the flashing flange itself is adapted to have no nails or other fasteners passing therethrough. This thus minimizes any chance for water entering the building about the skylight through the flashing flange membrane. In the installation of the unit, the flashing flange is simply lifted and the clip means is inserted into a slot in the curb frame. The clip means is then secured by nails or other fasteners and the flashing flange is then placed thereover. The shingles that are adapted to fit adjacent to the skylight are then placed over the co-extruded flexible flashing flange and it is preferred that in nailing these shingles that no nails be directed through the shingle and through the flashing flange. The nailing of the shingles simply occurs outside of the co-extruded flexible flashing flange.

In accordance with the present invention the aforementioned plurality of elongated spaced upstanding ribs are preferably provided in spaced sets with the spacing between sets of ribs being on the order of the width of each set. This has been found to provide enhanced flow diversion. Also, it is preferred to have a flashing cap extending upwardly from the flashing flange, generally of L-shape and adapted to receive the roofing shingles therein. An alternate to the aforementioned securing clip is the provision of a peripheral rigid base extension from the curb frame through which a fastening means such as a roof nail may extend for the purpose of securing the curb frame. This securing is carried out beneath the sealing flange so as not to interfere therewith. An integral sealing element is also provided and one element secured to one of the domes of the skylight and in the second embodiment integral with the curb frame itself. The curb frame in an alternate embodiment may also be provided with a pair of base recesses for having the capability of receiving securing clips either on the inside or outside of the curb frame.

In accordance with the invention, there is also provided an improved flexible flange mulling concept in which skylights may be essentially supported in adjacent position. In this embodiment of the invention, the peripheral flexible flashing flange of each curb frame is disposed in an overlapping position. The underlying flexible flashing flange may be trimmed to provide proper joining and there is provided a continuous seal between these overlapping flexible flashing flanges. The continuous seal is preferably provided with a PVC glue or cement. A common support is provided between the adjacent curb frames in the form of a continuous metallic hold down clip having opposite ends that are adapted to be received in slots of the respective spaced curb frames. A fastener such as a nail may be employed to secure the clip to the building. Within each slot that receives the clip, there are preferably provided sealing ribs co-extruded with the curb frame for providing a seal between the end of each clip and the corresponding curb frame.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

FIGS. 1–4 show one embodiment of the present invention. A preferred embodiment of the invention is illustrated in FIGS. 5–9 to be discussed in further detail hereinafter. FIGS. 10–13 illustrate further details regarding the mulling of skylight units and the associated technique of sealing between flanges.

Figure 1:
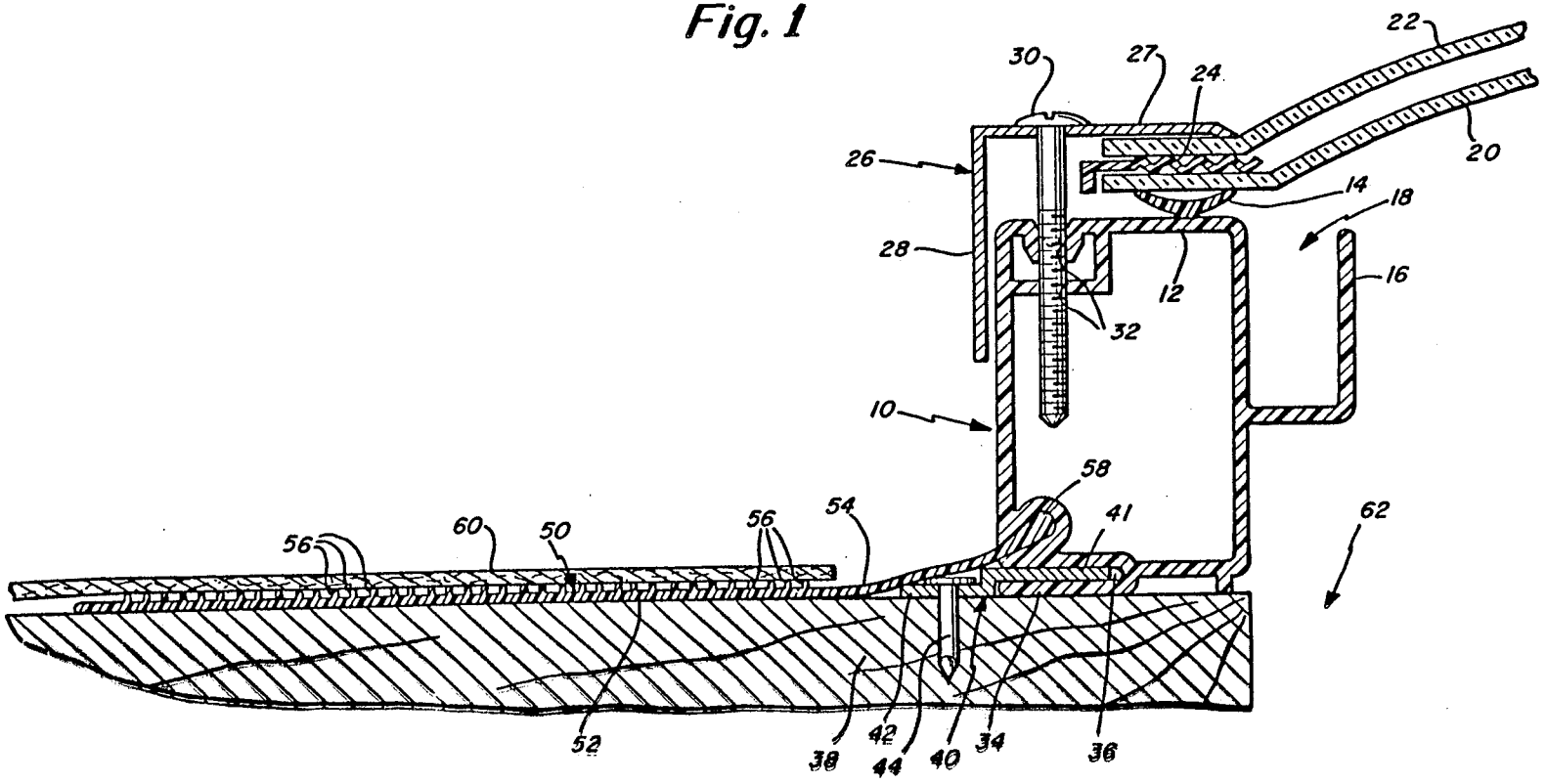
FIG. 1 is a cross-sectional view through a curb frame of a complete skylight unit illustrating the rigid curb frame and the co-extruded flexible flashing flange.

FIG. 1 is a cross-sectional view through one embodiment of the curb frame of the invention. FIG. 1 also illustrates the co-extruded flexible flashing flange of the invention. This integral peripheral flashing flange provides a much simpler alternative in the installation of skylights not requiring the use of roofing cement or step flashing kits. This embodiment of the invention also offers the additional benefit and flexibility of offering an installer the convenience of arranging adjacent units together in a cluster by simply trimming and gluing overlapping flashing pieces so as to essentially form a one-piece, self-flashing skylight. At the present time, clusters of skylights are interconnected by more complex techniques requiring complex mulling kits or are made in custom factory built units. In accordance with the present invention, the unit itself and the method of installation are extremely simple requiring fewer pieces and relatively simple instructions to be described in further detail hereinafter.

Figure 2:
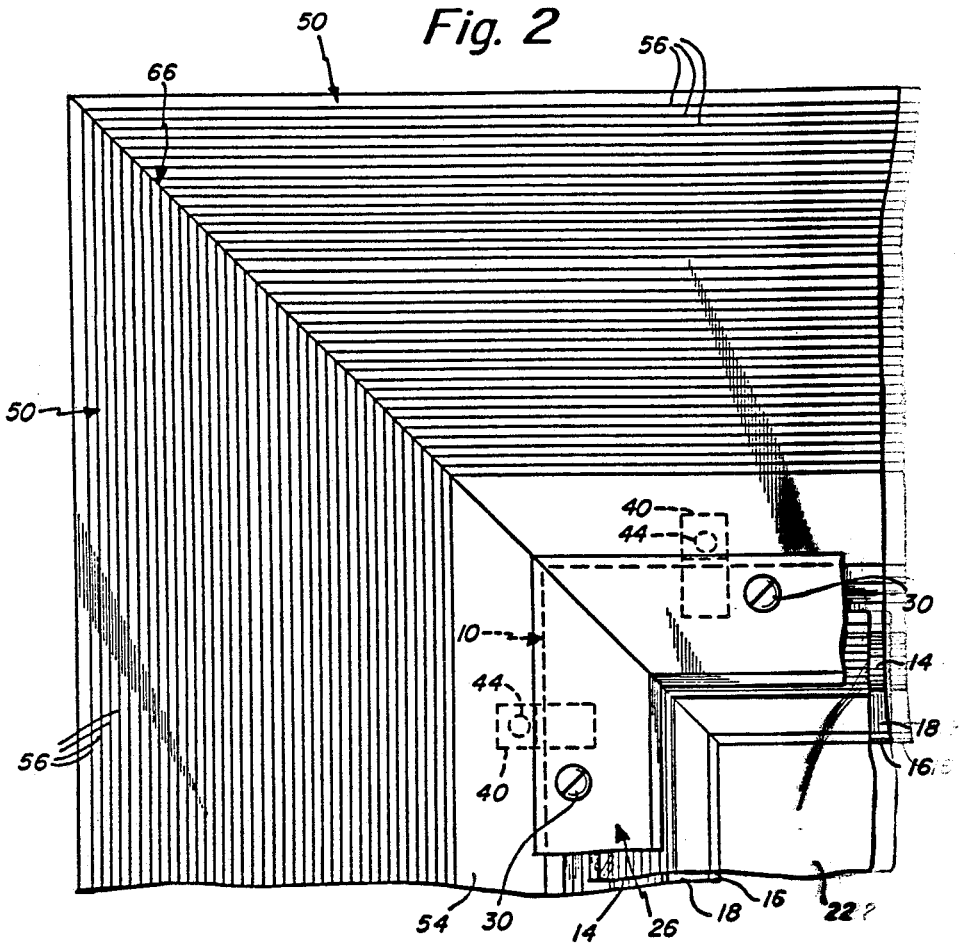
FIG. 2 is a fragmentary plan view illustrating in particular the, miter connection of the curb frame and associated co-extruded flexible flashing flange.
Figure 3:
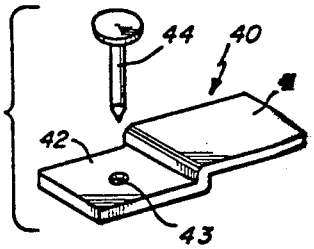
FIG. 3 perspective view illustrating the securing clip employed in connection with the invention.

Referring now to FIGS. 1–3, there is shown a skylight curb frame 10 that is constructed of a rigid plastic material, preferably a rigid PVC. The rigid curb frame 10 has a top wall 12 that is adapted to support the co-extruded glazing gasket 14. The curb frame 10 also has an inwardly directed wall 16 defining a condensation gutter 18. With regard to the glazing gasket 14, it is noted that this is co-extruded with the curb frame 10 but while the curb frame 10 is of a rigid PVC material, the gasket 14 is of a more flexible material.

FIG. 1 also illustrates the acrylic domes which comprise an acrylic inner dome 20 and an acrylic outer dome 22. The outer flange of the dome 20 rests upon the co-extruded glazing gasket 14. The outer dome 22 has its flange overlying the flange of the inner dome. In between these two flanges there is provided an extruded and welded dome seal gasket 24. The inner and outer acrylic domes along with the respective gaskets are maintained in place by means of the aluminum retainer 26 which includes a horizontal leg 27 and a vertical leg 28. A screw fastener 30 passes through the leg 27 and is secured appropriately in a receiving hole at 32 in the curb frame 10.

At the bottom of the curb frame 10 there is provided a leg 34 defining a slot 36. The slot 36 may extend about the entire periphery of the curb frame. The slot 36 is provided primarily for the purpose of securing the curb frame 10 itself directly to the building member 38. In order to carry out this securing, there is provided a securing clip 40. Depending upon the size of the skylight, four more of these securing clips may be disposed along the sides of the skylight.

Reference is now made to the perspective view of FIG. 3 which shows one version of the securing clip 40. The clip 40 has one end 41 that is adapted to fit within the slot 36 in the curb frame. The securing clip 40 also has another end 42 that is adapted to lie upon the building member 38 for securing thereto. For this purpose, the end 42 has a hole 43 for receiving a nail 44 or other fastener. The hole 43 may be prepunched. The securing clip 40 may be constructed of plastic or metal.

The flashing flange 50 is preferably constructed of a flexible PVC plastic. The flange 50 is co-extruded with the rigid curb frame 10 in the same manner as the co-extrusion of the glazing gasket 14. The co-extruded flexible flashing flange 15 may have a length on the order of 6 inches and has a flat bottom surface 52. The top surface 54 is provided with a series of upstanding ribs 56. FIG. 1 shows the flange 50 secured at end 58 thereof. This is secured within the rigid curb frame as illustrated in FIG. 1. The upstanding ribs 56 extend longitudinally as noted in FIG. 2 and form a series of flow diverters so that should any water enter under the shingle 16 between the shingle and these ribs, then the water will simply run down the roof and be diverted away from any area where the water might enter under the flashing flange. It is noted that there are a number of these ribs provided in relatively closely spaced relationship so that should the water pass one rib, there are a number of adjacent ribs to provide flow diversion. Also, because of the substantial number of ribs that are employed, there are also a number of contact points between the shingle that is disposed over the flashing flange and the flashing flange itself. With regard to the flow diversion, even at the bottom of the skylight where the ribs will tend to run substantially horizontally, these ribs are of very small height and thus any water directed from the side disposed ribs is simply for the most part deflected off of the bottom flange.

In accordance with the installation of the skylight illustrated in FIGS. 1–3, there is provided the usual opening in a building illustrated at 62 in FIG. 1 and the curb frame is adapted to be positioned about this opening on the building member 38. Between the base of the curb frame and the member 38 there may be some form of an asphalt paper. This asphalt paper is not illustrated in FIG. 1.

After placement of the curb frame in the proper position about the skylight opening, then a series of the clips 40 are used for securing the curb frame in place. FIG. 1 illustrates one of these clips. FIG. 3 illustrates the clip in a perspective view and FIG. 2 illustrates what might be a typical placement of clips near to the mitered corner.

The flashing flange 50 is flexible and thus readily lifted upwardly, essentially pivoted at its end 58 so as to provide access to the base of the curb frame for insertion of the clips 40. The clips 40 as indicated previously are secured by means of a nail 44 or the like fastener. Thereafter, the flashing flange 50 is then moved downwardly to the position illustrated in FIG. 1 for covering the roof or other structure. Preferably, a plurality of these clips are used on each side of the skylight. The number of clips that are used are the function of the size of the skylight with the larger number of clips being used on larger skylights.

After the co-extruded flexible flashing flange has been placed in the manner illustrated in FIG. 1, then shingles 60 are placed thereover in the usual manner. In a preferred method of installation, the shingles 60 are disposed over the flange as illustrated. These shingles are arranged in the usual manner overlapping each other such as illustrated in copending application Ser. No. 453,339 filed Dec. 27, 1982. However, in accordance with the preferred procedure of installation, the shingles are not to be secured through the flashing flange 50. It is preferred not to pierce the flashing flange 50 with any nails. Instead, the nailing of each shingle occurs outside of the flashing flange. This minimizes any chance of water diversion through a hole created by a nail piercing the shingle and flashing flange.

With regard to FIG. 2, it is noted that the curb frame and the flashing flange are both joined at the miter 66. Because the curb frame and the flashing flange and glazing gasket are all formed integrally as a co-extrusion, these elements can also be cut at a bevel and remain as a co-extrusion. The individual parts once mitered are then heat welded to form a one-piece rectangular curb frame with an integral welded flashing skirt or flange about the entire curb perimeter as illustrated in the fragmentary view of FIG. 2.

Figure 4:
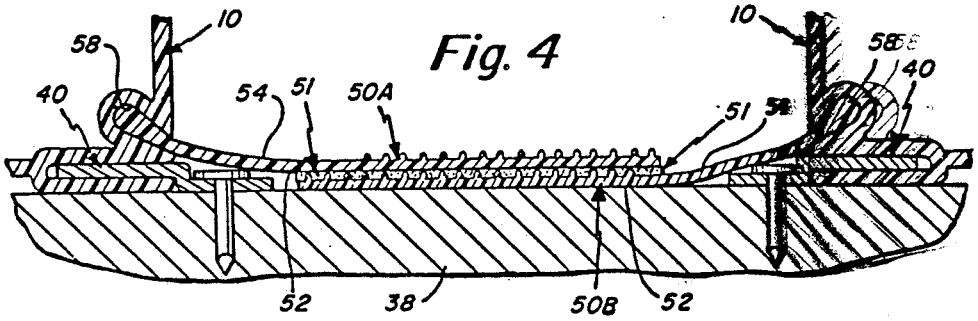
FIG. 4 is a fragmentary cross-sectional view illustrating the manner in which skylights can be arranged in adjacent position with the flashing flanges in an overlapping arrangement.

Reference is now made to the cross-sectional view of FIG. 4 which shows in a fragmentary view the joining essentially of adjacent skylights without requiring the use of any covering shingles. In this way, there can be an installation of a cluster of skylights without requiring complex custom units. This is carried out by simply trimming the flanges 50A and 50B in FIG. 4 if necessary. Trimming occurs depending upon the closeness with which the skylights are to be arranged. The glue is then applied at 51 between the overlapping portions of the flanges 50A and 50B. Once the flanges are glued, then there is formed an integral flexible flashing arrangement essentially providing a one-piece connection between skylights.

In connection with the method of installation of the present invention, it has been noted previously that shingles are provided over the flashing flange with instructions being provided not to pierce the flashing flange. In addition to that, it may also be preferred to provide a row of shingles under the flashing flange at the bottom of the skylight along with a row of shingles over the top of the flashing flange at the bottom of the skylight.

Figure 5:
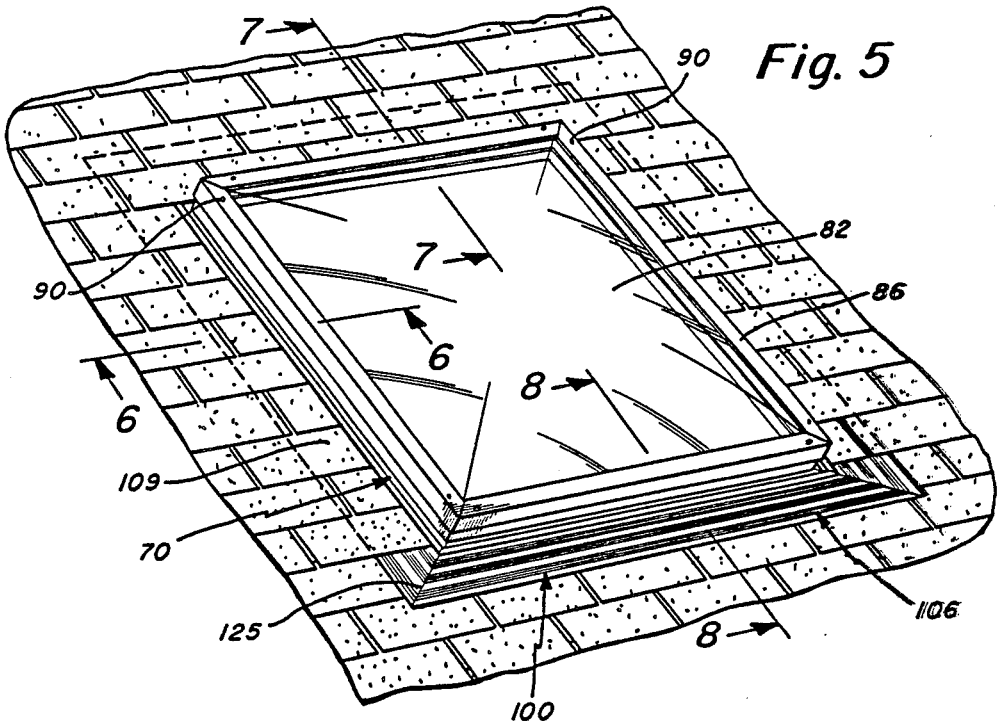
FIG. 5 is a perspective view showing the preferred embodiment of the present invention as secured in a roof opening.
Figure 6:
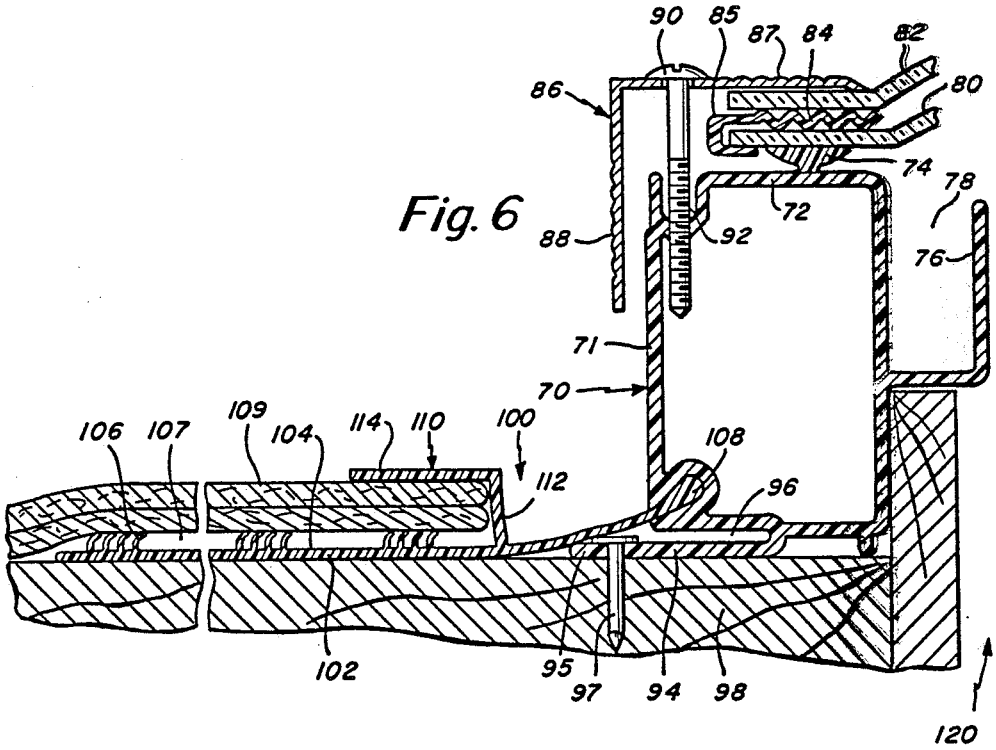
FIG. 6 is a cross-sectional view through the curb frame showing further details at the side thereof and taken along line 6—6 of FIG. 5.

FIG. 5 is a perspective view of the preferred embodiment of the present invention illustrating a curb frame 70 that is constructed of a rigid plastic material, preferably a rigid PVC. Also refer to FIGS. 6–8 which show respective cross-sectional views taken at the side, top and bottom of the skylight curb frame. The rigid curb frame 70 has a top wall 72 (see FIG. 6) that is adapted to support the co-extruded cup-shaped gasket 74. The curb frame 70 also has an inwardly directed wall 76 defining a condensation gutter 78 as illustrated in FIG. 6. With regard to the gasket 74, it is noted that this is co-extruded with the curb frame 70. However, while the curb frame 70 is of a rigid PVC material, the gasket 74 is of a more flexible material.

FIGS. 5 and 6 also illustrate the acrylic domes which comprise an acrylic inner dome 80 and an acrylic outer dome 82. The outer flange of the dome 80 rests upon the co-extruded gasket 74. The outer dome 82 has its flange overlying the flange of the inner dome 80. In between these two flanges there is provided a gasket 84 having a turned end 85 that is adapted to fit about the flange of the dome 80 essentially securing the gasket 84 in place so that it is easier to then dispose the dome 82 thereover. The gasket 84 with its turned end 85 essentially slips onto the edge of the flange of the dome 80.

The inner and outer acrylic domes 80 and 82, along with the respective gaskets, are maintained in place by means of the aluminum retainer 86. The retainer 86 includes a horizontal leg 87 and a vertical leg 88. A screw fastener 90 passes through the leg 87 and is secured appropriately in a receiving hole at 92 in the curb frame 70.

At the bottom of the curb frame 70 there is provided a leg 94 defining a slot 96. The slot 96 along with the leg 94 may extend about the entire periphery of the curb frame. The slot 96 is similar to the slot 36 illustrated in FIG. 1 and may be used for the purpose of securing the curb frame 70 itself directly to the building member 98. However, rather than the use of the securing clips 40 illustrated in FIG. 1, a more simplified arrangement is shown in FIG. 6 in which the leg 94 has an outwardly extending integral extension 95 that may be drilled to receive the securing nail 97. In this way there is no need for a separate securing clip as illustrated in FIG. 1. It is noted in FIG. 6 that the extension 95 extends beyond the outer wall 71 of the curb frame so as to provide access to the extension 95. When installing the curb frame, the sealing flange may simply be lifted to provide access to the extension so that the extension can be nailed down to secure the curb frame in its proper position.

Figure 7:
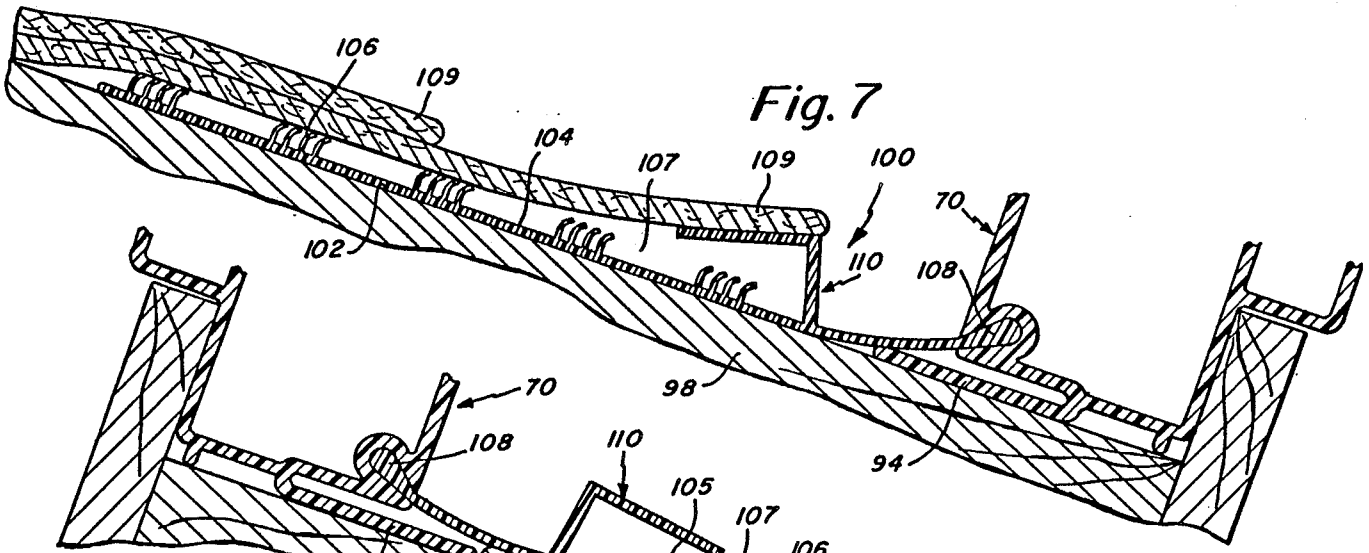
FIG. 7 is a cross-sectional view taken through the skylight at the top thereof and taken along line 7—7 of FIG. 5.
Figure 8:
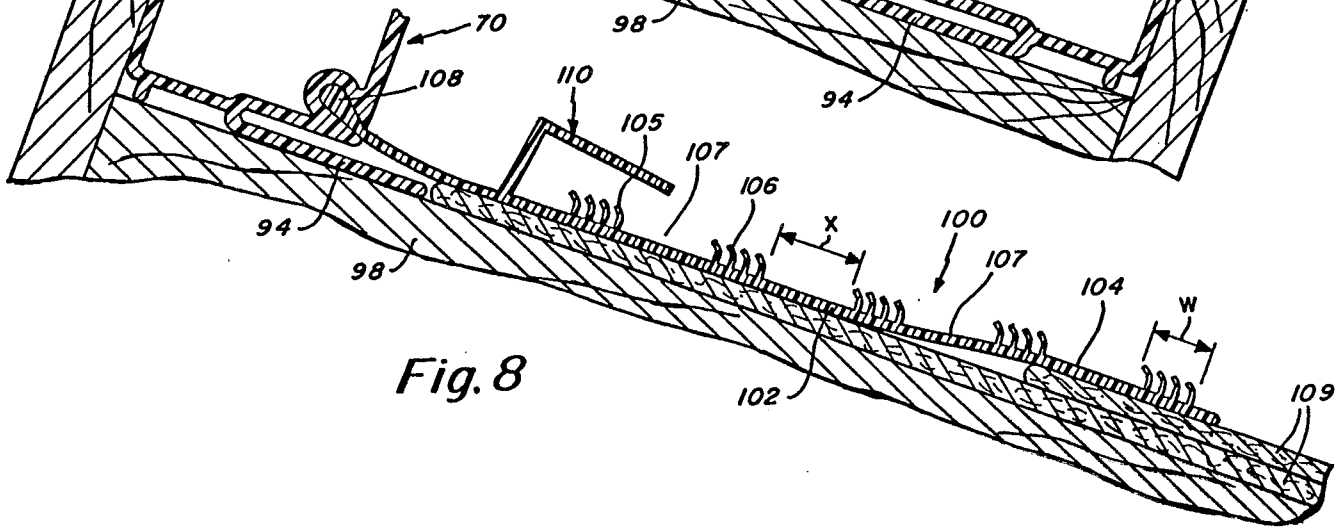
FIG. 8 is a cross-sectional view showing further details of the skylight taken at the bottom of the curb frame and taken along line 8—8 of FIG. 5.

The flashing flange 100 is provided as illustrated in the perspective view of FIG. 5 and is furthermore illustrated in the cross-sectional views of FIGS. 6–8. The flashing flange 100 is preferably constructed of a flexible PVC plastic. Flange 100 is co-extruded with the rigid frame 70 in the same manner as the co-extrusion of the gasket 74. The co-extruded flexible flashing flange 100 may have a length on the order of 6 inches and has a flat bottom surface 102. The top surface 104 of the flange is provided with a series of upstanding ribs 106. The ribs 106 are provided in spaced sets. In the particular embodiment disclosed herein, each set comprises four elongated ribs. The sets of ribs are separated by valleys 107 in which there is an absence of any ribs. It has been found that by providing an open valley area the water diversion is improved. As illustrated in FIG. 8, each of the sets may have a width W that is comparable to the width of the valley 107 illustrated in FIG. 8 as the width X. Actually, the width of the set of ribs is perhaps slightly less than the width of the valley.

Also, each of the upstanding ribs 106 is preferably not totally vertical but is hooked, such as illustrated in FIG. 8, at 105.

FIGS. 6–8 illustrate the flange 100 secured at end 108 thereof. This is secured within the rigid curb frame such as illustrated in FIG. 6. The ribs 106 extend longitudinally as noted in FIG. 5 and form a series of flow diverters so that should any water enter under the shingle 109 between the shingle and these ribs, then the water simply runs down the roof and is diverted away from any area where the water might enter under the flashing flange.

In connection with the illustration of FIG. 5, it is noted that cross-sectional views have been taken at the side of the curb frame as well as at the top and bottom, all illustrated in respective FIGS. 6–8. In FIG. 6, as well as in FIGS. 7 and 8, it is noted that the flashing flange 100 has a flashing cap 110 that in FIG. 6 includes a substantially vertical leg 112 and a substantially horizontal leg 114. FIG. 8 shows the flashing cap 110 in its normal non-deflected position. It is noted that in FIG. 6 the shingles 109 are disposed inside of the flashing cap 110 and rest upon the flow-diverting ribs 106.

In FIG. 7, which is a cross-sectional view taken at the top of the skylight, the shingles 109 extend over the ribs 106 and likewise also extend to cover the flashing cap 110. FIG. 8 is a cross-sectional view at the bottom of the curb frame and in this instance it is noted that the shingles 109 are disposed under the flashing flange 100. In addition, there also may be a row of shingles disposed over the flashing flange 100, although this is not illustrated in FIG. 8.

In accordance with the installation of the skylight illustrated in FIGS. 5–8, there is provided the usual opening in a building illustrated at 120 (see FIG. 6). In the drawing the curb frame is adapted to be positioned about this opening on the building member 98. Between the base of the curb frame and the member 98 there may be some form of an asphalt paper. This asphalt paper is not illustrated in the drawings.

After placement of the curb frame in the proper position about the skylight opening, then a series of nails 97 are used for securing the curb frame in place by passing through the extension 95 of the leg 94. With this arrangement, unlike the arrangement of FIG. 1, there is no separate securing clip thus making the securing task easier.

The flashing flange 100 is flexible and thus readily lifted upwardly, essentially pivoting at its end 108 so as to provide access to the base of the curb frame for securing of the nails 97. A hammer may be used for that purpose. Thereafter, the flashing flange 100 is then moved downwardly to the position illustrated in, for example, FIG. 6, for covering the roof or other structure. Preferably, a plurality of nails is used on each side of the skylight. The number of nails that are used are a function of the size of the skylight with a larger number of securing nails being used of course on larger skylights.

After the co-extruded flexible flashing flange has been placed in the manner illustrated in FIGS. 5–8, then shingles 109 are placed thereover in the usual manner. In a preferred method of installation, the shingles 109 are disposed over the flange such as illustrated in FIG. 6 and on the sides under the flashing cap 110. These shingles are arranged over the flashing cap at the top, as illustrated in FIG. 7. These shingles are arranged in the usual manner overlapping each other such as illustrated in co-pending application Ser. Number 06/453,339, filed Dec. 27, 1982 now U.S. Pat. No. 4,527,368, dated July 9, 1985. However, in accordance with the preferred procedure of installation, the shingles are not to be secured through the flashing flange 50. It is preferred not to be secured through the flashing flange 100. It is preferred not to pierce the flashing flange with any nails. Instead, the nailing of each shingle preferably occurs outside of the flashing flange. This minimizes any chance of water diversion through a hole created by a nail piercing the shingle and flashing flange.

With regard to FIG. 5, it is noted that the curb frame and the flashing flange are both joined at the miter 125. Because the curb frame and the flashing flange and glazing gasket are all formed integrally as a co-extrusion, these elements can also be cut at a bevel and remain as a co-extrusion. The individual parts once mitered are then heat-welded to form a one-piece rectangular curb frame with an integral welded flashing skirt or flange about the entire curb perimeter as illustrated herein.

Figure 9:
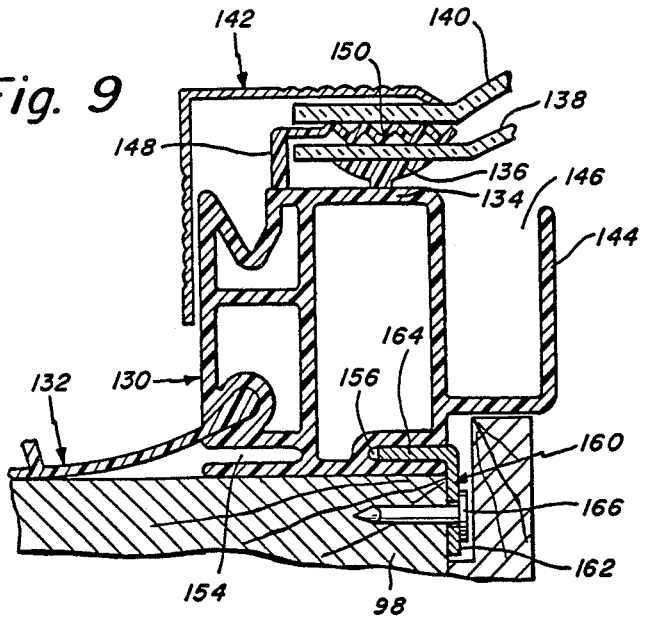
FIG. 9 is a cross-sectional view of an alternate embodiment to that illustrated, for example, in FIG. 6 showing the use of an alternate securing means for the curb frame and also an alternate arrangement for the sealing element between domes of the skylight.

FIG. 9 illustrates a cross-sectional view similar to the view of FIG. 6 but for an alternate embodiment of the invention. In FIG. 9 there is shown the curb frame 130 having co-extruded therewith the flashing flange 132. The flashing flange 132 may be of the same construction as illustrated in FIGS. 5–8. The curb frame 130 includes a top wall 134 for supporting the cup-shaped gasket 136. There are also provided a pair of domes including an inner dome 138 and an outer dome 140. These domes are retained in place by the retainer 142 which may be an aluminum retainer, such as illustrated in FIG. 9. The curb frame 130 is also provided with an external wall 144 forming a condensation gutter 146 at the inside of the curb frame.

There are basically two alternate featured illustrated in FIG. 9 that require consideration. First, integral with the curb frame 130 at the top wall 134 is an upright member 148 that is integral with a sealing gasket 150. The gasket 150 is adapted to be disposed between the flanges of the respective domes 138 and 140. The integral nature of the member 148 and gasket 150, being integral with the curb frame 130, provides an improvement in that there is no need any longer for a separate gasket to be installed. The lower dome 138 is simply inserted between the gasket 136 and the gasket 150 and then the upper dome 140 is disposed thereover. The retainer is then secured in place to hold the domes in place against the peripheral curb frame.

The second feature illustrated in FIG. 9 has to do with the fact that the curb frame 130 now has a dual means of securing and for this purpose is provided with an outer slot 154 and an inner slot 156. A clip such as illustrated in FIG. 1 of this application may be used in the slot 154 for securing the curb frame at its outer side. However, an alternate means of securing is illustrated in FIG. 9 in which there is provided a clip 160 having a substantially vertical leg 162 and a substantially horizontal leg 164. The leg 164 is adapted to fit in the slot 156. The vertical leg 162 is adapted to rest against a side surface of the member 98. A securing nail 166 is used, which passes through a hole in the vertical leg 162 of the clip 160 for securing the clip in place and likewise also securing the curb frame itself in place about the skylight opening.

Figures 10, 11, 12, 13:
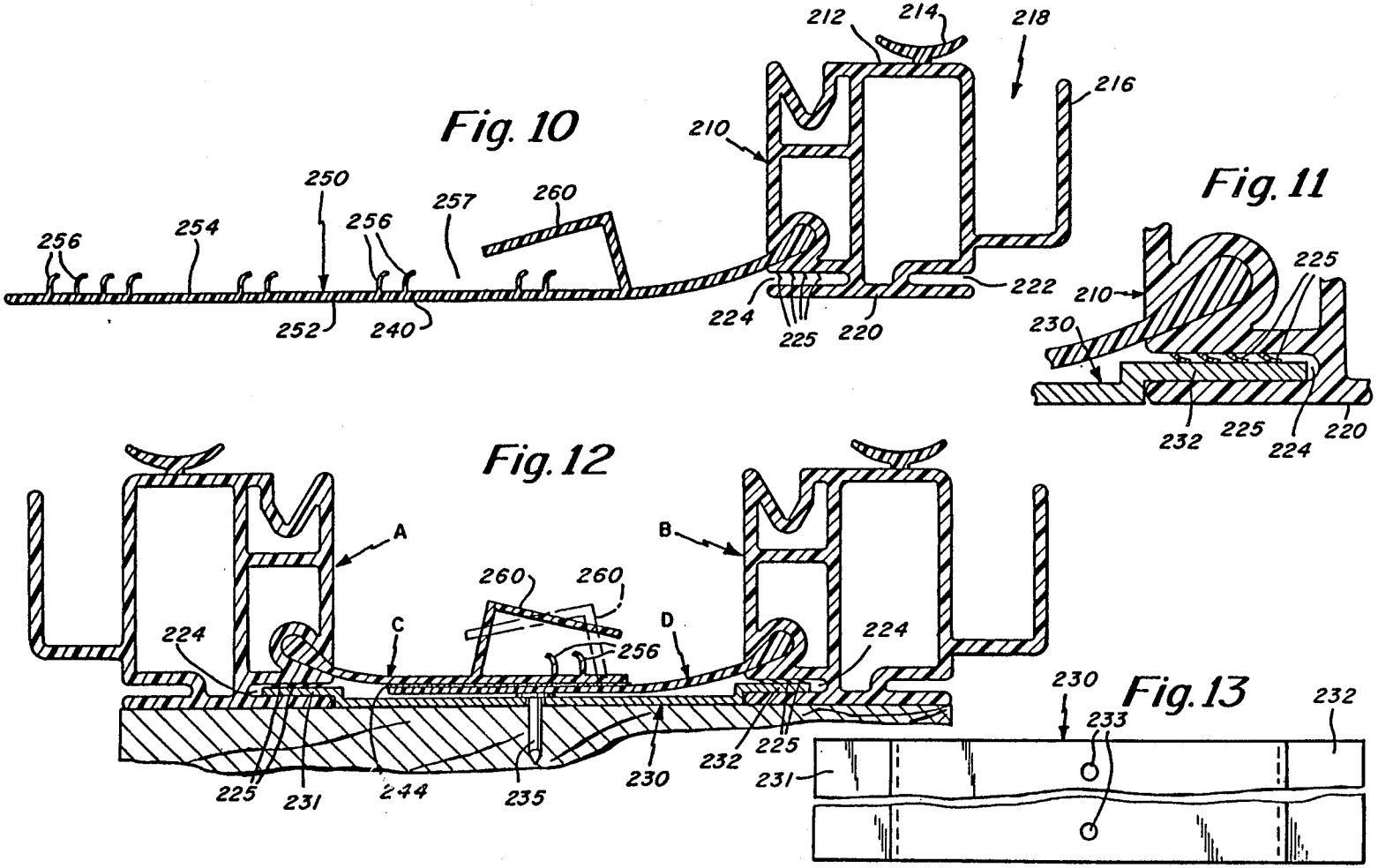
FIG. 10 is a cross-sectional view similar to the view of FIG. 6 showing a slightly different rib pattern, and furthermore illustrating sealing ribs in the curb frame securing slot.
FIG. 11 is a fragmentary enlarged view illustrating the sealing ribs in the curb frame slot.
FIG. 12 is a cross-sectional view illustrating the flexible flange mulling concepts of the present invention, and furthermore illustrating the continuous securing clip that is used curb frames.
FIG. 13 is a plan view of the elongated metallic securing clip shown in FIG. 12.

FIG. 10 is a cross-sectional view through one embodiment of the curb frame of the invention illustrating the co-extruded flexible flashing flange of the invention. In this particular embodiment, as also illustrated in FIGS. 11–13, there is the additional benefit and flexibility of offering an installer, the convenience of arranging adjacent units together in a cluster by trimming and gluing the overlapping flashing flanges so as to essentially form a one-piece, self-flashing skylight as indicated previously. Presently clusters of skylights are interconnected by more complex techniques requiring complex mulling kits or are made in custom factory built units.

In FIG. 10 there is shown the skylight curb frame 210 that is constructed of a rigid plastic material, preferably a rigid PVC. The rigid curb frame 210 has a top wall 212 that is adapted to support the co-extruded glazing gasket 214. The curb frame 210 also has an inwardly directed wall 216 defining a condensation gutter 218. With regard to the glazing gasket 214, it is noted that this is co-extruded with the curb frame 210, but while the curb frame 210 is of a rigid PVC material, the gasket 214 is of a more flexible PVC material.

FIG. 10 also illustrates the base 220 of the curb frame 210. Defined just above the base 220 are inner and outer slots identified in FIG. 10 as an inner slot 222 and an outer slot 224. The slots 222 and 224 may extend about the entire periphery of the curb frame. These slots are provided for the purpose of securing the curb frame 210 directly to the building structure.

FIG. 10 also shows the flashing flange 250 which is preferably constructed of a flexible PVC plastic. The flange 250 is co-extruded with the rigid curb frame 210 basically in the same manner as the co-extrusion of the glazing gasket 214. The co-extruded flexible flashing flange 250 may have a length on the order of 6 inches and has a flat bottom surface 252. The top surface 254 of the flashing flange is provided with upstanding ribs 256. The ribs 256 are provided in spaced sets. In the embodiment of FIG. 10, most of the sets comprise two elongated ribs with the exception of the outer set which comprises four elongated ribs. The sets of ribs are separated by valleys 257 in which there is an absence of any ribs. It has been found that by providing an open valley area, the water diversion is improved. Also, each of the upstanding ribs 256 is preferably not totally vertical but is hooked, such as has been previously illustrated in FIG. 8.

FIG. 10 also illustrates the flashing cap 260 which basically is of the same construction as illustrated previously in FIG. 6.

Reference is now made to FIG. 11 which shows an enlarged detail of the slot 224 further illustrating the sealing ribs 225 that may extend peripherally about the entire frame. These ribs 225 are adapted to sealing against the securing clip 230. In this regard, also note the securing clip 230 shown in FIG. 12. It is the end 232 thereof that actually is inserted into the slot 224 and that comes into contact with the sealing ribs 225. Should any water for any reason get under the flashing flange, then a further seal is provided between the clip and the sealing ribs 225.

Reference is now made to FIG. 13, which shows one form of a hold down clip 230 as used in practicing the mulling arrangement of FIG. 12. It is noted that the clip 230 has an elongated center section and also has opposite ends 231 and 232. As illustrated in FIG. 11, one of the ends 232 was shown in one of the receiving slots of a curb frame. In a preferred embodiment of the invention, the hold down clip 230 extends along an entire side of the curb frame between adjacent curb frames. It is also noted in FIG. 13 that the clip 230 has at least one center hole 233 for receiving a fastener such as the nail 235 illustrated in FIG. 12. The hold down clip 230 is preferably metallic, such as aluminum. As indicated previously, the hold down clip 230 preferably extends along the entire side of the curb frame. At the top and bottom of the clip, an epoxy adhesive may be used for providing a proper seal between the ends of the clip and the skylight curb frame. Again, the clip 230 that extends the entire length of the curb frame provides a second water tight sealing barrier by virtue of contact of the end 232 of the clip with the sealing ribs 225 as illustrated in FIG. 11. Thus, there is a sealing joint provided by the overlapping of the flanges as well as the sealing provided as indicated in FIG. 11 between the clip 230 and the base of the curb frame at the ribs 225.

Reference is now made to FIG. 12 which shows the mulling concepts of the present invention, in which two skylight curb frames are adapted for positioning relatively close to each other. In FIG. 12, these curb frames are illustrated by curb frame A on the left and curb frame B on the right. The curb frame A has associated therewith, a flexible sealing flange C and similarly the curb frame B has an associated flexible sealing flange D. Once again, the elongated hold down clip 230 is used for positioning the curb frames A and B in the manner illustrated in FIG. 12. A fastener such as the nail 235 is used for holding the clip 230 in position. It is noted that the ends 231 and 232 of the clip are held in the slots provided above the base of each of the curb frames, in the manner as illustrated in FIG. 11. Of course, each of the curb frames on their opposite sides also have clips that may be like the clip 230 if there is a further skylight being assembled therewith, or they can be a clip of the type illustrated previously, such as in FIG. 1.

When overlapping the flanges C and D in FIG. 12, it is noted that with regard to the underlying flange D the flashing cap 260 is to be removed so that it does not interfere with the upper flange. This is shown in dotted outline in FIG. 12. Similarly, some of the ribs 256 may also be removed so that the top surface of the flange D is flat. In this connection, it is noted that with reference to FIG. 10, the flanges are each trimmed at about location 240.

In order to provide a seal between the overlapping flanges, there is provided a PVC cement at 244. This may be coated onto the lower flange and then the upper flange is overlapped and pressed against the lower flange.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. In a skylight for covering an opening in a building comprising, a curb frame extending about the opening, means for securing the curb frame in place about the opening, translucent or transparent means covering the opening and extending at its edges to the curb frame, means for retaining the covering means on the curb frame, said curb frame being constructed of a rigid thermoplastic material having co-extruded and integral therewith at least one gasket of flexible thermoplastic material for providing a seal between the curb frame and covering means and furthermore having co-extruded and integral therewith a flashing flange extending from the base of the curb frame about the periphery of the curb frame and of a flexible thermoplastic material, said rigid thermoplastic material forming the curb frame as well as the co-extruded flexible gasket and co-extruded flexible flashing flange all being commonly sealed to join the curb frame mitres and also simultaneously secure the gasket and flashing flange at the curb frame mitres to provide a continuous seal about the curb frame.

2. A skylight as set forth in claim 1 wherein said rigid thermoplastic is a rigid PVC and said flexible thermoplastic is a flexible PVC.

3. A skylight as set forth in claim 1 wherein both said curb frame and gasket are heat sealed at the mitres.

4. A skylight as set forth in claim 1 wherein said means for securing the curb frame to the building comprises clip means.

5. A skylight as set forth in claim 1 including a second curb frame and associated flexible flashing flange in which said flashing flanges are adapted to overlap and be secured together.

6. A skylight as set forth in claim 1 wherein the width of said flashing flange is on the order of 6 inches and the ribs are spaced on the order of ⅛th inch apart.

7. A skylight as set forth in claim 1 in combination with shingle means over the flashing flange, said shingle means adapted to be secured to the building but only outside of the flashing flange.

8. A skylight as set forth in claim 1 wherein said flexible flange has a plurality of elongated spaced upstanding ribs that form flow diverters extending peripherally about the curb frame.

9. A skylight as set forth in claim 8 wherein the co-extruded flashing flange is wider than the curb frame.

10. A skylight as set forth in claim 1 wherein said curb frame has a base slot for receiving a portion of said clip means.

11. A skylight as set forth in claim 10 wherein said clip means comprises one end that is adapted to be received by said slot and a second end that has a hole for receiving a nail or the like fastener.

12. A skylight as set forth in claim 1 wherein said curb frame has a plurality of walls including a top wall for supporting said gasket.

13. A skylight as set forth in claim 12 wherein said plurality of walls define a hollow duct that is substantially closed.

14. A skylight as set forth in claim 13 wherein said hollow duct overlies a support wall for the curb frame and underlies said gasket and covering means.

15. A skylight as set forth in claim 1 wherein said flashing flange has a plurality of elongated spaced upstanding ribs that form flow diverters extending peripherally about the curb frame, said plurality of elongated spaced upstanding ribs being provided in separate sets with each set comprising a plurality of ribs.

16. A skylight as set forth in claim 15 wherein the spacing between sets is greater than the inter-rib spacing in a set.

17. A skylight as set forth in claim 16 wherein the spacing between sets of ribs is on the order of the width of each set.

18. A skylight as set forth in claim 17 wherein each rib is of hook-shape.

19. In a skylight for covering an opening in a building comprising, a curb frame extending about the opening, means for securing the curb frame in place about the opening, translucent or transparent means covering the opening and extending at its edges to the curb frame, means for retaining the covering means on the curb frame, said curb frame being constructed of a rigid thermoplastic material having integral therewith at least one gasket of flexible thermoplastic material for providing a seal between the curb frame and covering means and furthermore having integral therewith a flashing flange extending from the base of the curb frame about the periphery of the curb frame and of a flexible thermoplastic material, said rigid thermoplastic material forming the curb frame as well as the flexible gasket and flexible flashing flange all being commonly sealed to join the curb frame mitres and also simultaneously secure the gasket and flashing flange at the curb frame mitres to provide a continuous seal about the curb frame.

20. A skylight as set forth in claim 19 wherein said flexible flashing flange is co-extruded with said rigid curb frame.

21. A skylight as set forth in claim 20 wherein said flexible flashing flange carries flow diverter means extending about the curb frame to divert water flow away from the flashing flange.

22. A skylight as set forth in claim 21 wherein the flashing flange carries the flow diverter means on a top surface thereof.

23. A skylight as set forth in claim 22 wherein the flow diverter means comprises elongated rib means.

24. A skylight as set forth in claim 23 wherein said elongated rib means comprises a plurality of elongated spaced upstanding ribs.

25. A skylight as set forth in claim 24 wherein said elongated spaced upstanding ribs are provided in separate sets with each set comprising a plurality of ribs.

26. A skylight as set forth in claim 25 wherein the spacing between sets is greater than the inter-rib spacing in a set.

27. A skylight as set forth in claim 26 wherein the spacing between sets of ribs is on the order of the width of each set.

28. A skylight as set forth in claim 27 wherein each rib is of hook-shape.

29. A skylight as set forth in claim 28 wherein said flexible gasket is co-extruded with said rigid curb frame.

30. In a skylight for covering an opening in a building comprising, a curb frame extending about the opening, means for securing the curb frame in place about the opening, translucent or transparent means covering the opening and extending at its edges to the curb frame, means for retaining the covering means on the curb frame, said curb frame being constructed of a rigid thermoplastic material having integral therewith at least one gasket of flexible thermoplastic material for providing a seal between the curb frame and covering means and furthermore having integral therewith a flashing flange extending from the base of the curb frame about the periphery of the curb frame and of a flexible thermoplastic material, said rigid thermoplastic material forming the curb frame as well as the flexible gasket and flexible flashing flange all being commonly sealed to join the curb frame mitres and also simultaneously secure the gasket and flashing flange at the curb frame mitres to provide a continuous seal about the curb frame, said flexible flashing flange carrying flow diverter means extending about the curb frame to divert water flow away from the flashing flange.

31. A skylight as set forth in claim 30 wherein said flexible gasket is co-extruded with said rigid curb frame.

32. A skylight as set forth in claim 30 wherein said flexible flashing flange is co-extruded with said rigid curb frame.

33. A skylight as set forth in claim 32 wherein the flashing flange carries the flow diverter means on a top surface thereof.

34. A skylight as set forth in claim 33 wherein the flow diverter means comprises elongated rib means.

35. A skylight as set forth in claim 34 wherein said elongated rib means comprises a plurality of elongated spaced upstanding ribs.

36. A skylight as set forth in claim 35 wherein said elongated spaced upstanding ribs are provided in separate sets with each set comprising a plurality of ribs.

37. A skylight construction having a frame, transparent or translucent means supported by said frame, said frame being constructed of a rigid thermoplastic material having co-extruded and integral therewith a sealing gasket of flexible thermoplastic material, said frame further having co-extruded and integral therewith a flashing flange extending from the base of the flexible thermoplastic material, said rigid thermoplastic material forming the frame as well as the co-extruded flexible flashing flange being commonly sealed to join the frame mitres and also simultaneously secure the flashing flange at the frame mitres to provide a continuous seal about the frame.

38. A skylight construction as set forth in claim 37 wherein the width of the flashing flange is on the order of 6 inches.

39. A skylight construction as set forth in claim 37 wherein said sealing gasket extends from a face wall of said frame.

40. A skylight construction as set forth in claim 37 wherein the co-extruded flexible gasket is also commonly sealed with the rigid frame to join frame mitres and also simultaneously secure the flashing flange at the frame mitres to provide a continuous seal about the curb frame.

41. A skylight construction as set forth in claim 40 wherein both said frame and flexible flange are heat-sealed at the mitres.

42. A skylight construction as set forth in claim 41 wherein said flexible flange has flow diverter means extending peripherally about the curb frame.

43. A skylight construction as set forth in claim 42 wherein said flow diverter means comprises a plurality of elongated spaced upstanding ribs that form said flow diverters.

44. A skylight construction having a frame, transparent or translucent means supported by said frame, said frame being constructed of a rigid thermoplastic material, said frame further having co-extruded and integral therewith a flashing flange extending from the base of the frame about the periphery thereof and of a flexible thermoplastic material, said rigid thermoplastic material forming the frame as well as the co-extruded flexible flashing flange being commonly sealed to join the frame mitres and also simultaneously secure the flashing flange at the frame mitres to provide a continuous seal about the frame.

45. A skylight construction as set forth in claim 44 wherein both the frame and flexible flange are heat-sealed at the mitres.

46. In a skylight for covering an opening in a building having a rigid curb frame with means associated therewith for supporting a cover means, means for securing the curb frame to the building, and a flashing flange extending from the base of the curb frame and disposed about the periphery of the curb frame, said flashing flange having a plurality of elongated spaced upstanding ribs that form flow diverters extending peripherally about the curb frame.

47. In a skylight as set forth in claim 46 wherein said flashing flange is flexible and is co-extruded with said curb frame with the flexible flashing flange being of a more flexible material in comparison with the rigid curb frame.

48. In a skylight as set forth in claim 46 wherein the co-extruded flexible flashing flange is wider than the curb frame.

49. In a skylight as set forth in claim 46 including a second curb frame and associated flexible flashing flange in which said flashing flanges are adapted to overlap and be secured together.

50. In a skylight as set forth in claim 46 wherein the width of said flashing flange is on the order of 6 inches and the ribs are spaced on the order of ½ inch apart.

51. In a skylight as set forth in claim 46 in combination with shingle means over the flashing flange, said shingle means adapted to be secured to the building but only outside of the flashing flange.

52. In a skylight as set forth in claim 46 further including a glazing gasket on the curb frame, wherein said glazing gasket and flexible flashing flange are both co-extruded with the rigid curb frame.

53. In a skylight as set forth in claim 46 wherein said means for securing the curb frame to the building comprises clip means.

54. In a skylight as set forth in claim 53 wherein said curb frame has a base slot for receiving a portion of said clip means.

55. In a skylight as set forth in claim 54 wherein said clip means comprises one end that is adapted to be received by said slot and a second end that has a hole for receiving a nail or the like fastener.

56. In a skylight as set forth in claim 55 wherein one end of said flange is supported at said curb frame base but disposed over said curb frame base slot.

* * * * *